US010330128B2

(12) United States Patent
Moriki et al.

(10) Patent No.: US 10,330,128 B2
(45) Date of Patent: Jun. 25, 2019

(54) HYDRAULIC CONTROL SYSTEM FOR WORK MACHINE

(71) Applicant: HITACHI CONSTRUCTION MACHINERY CO., LTD., Tokyo (JP)

(72) Inventors: Hidekazu Moriki, Mito (JP); Shinya Imura, Toride (JP); Tsutomu Udagawa, Tsukuba (JP); Ryohei Yamashita, Tsuchiura (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 100 days.

(21) Appl. No.: 15/504,864

(22) PCT Filed: Aug. 28, 2015

(86) PCT No.: PCT/JP2015/074544
§ 371 (c)(1),
(2) Date: Feb. 17, 2017

(87) PCT Pub. No.: WO2016/072135
PCT Pub. Date: May 12, 2016

(65) Prior Publication Data

US 2017/0268540 A1 Sep. 21, 2017

(30) Foreign Application Priority Data

Nov. 6, 2014 (JP) ..... 2014-226519

(51) Int. Cl.
*E02F 9/22* (2006.01)
*F15B 11/16* (2006.01)
(Continued)

(52) U.S. Cl.
CPC ..... *F15B 11/161* (2013.01); *E02F 3/32* (2013.01); *E02F 9/22* (2013.01); *E02F 9/2267* (2013.01);
(Continued)

(58) Field of Classification Search
CPC ..... F15B 11/10; F15B 11/161; F15B 11/17; F15B 11/00; E02F 9/2292; E02F 3/32; E02F 9/2271; E02F 9/2267; E02F 9/22
See application file for complete search history.

(56) References Cited

U.S. PATENT DOCUMENTS 7,506,507 B2 * 3/2009 Fransson ..... E02F 9/2217 60/443
8,720,196 B2 * 5/2014 Kawasaki ..... E02F 9/2075 60/422
(Continued)

FOREIGN PATENT DOCUMENTS

EP 2 489 883 A1 8/2012
JP 06-123302 A 5/1994
(Continued)

OTHER PUBLICATIONS

International Preliminary Report on Patentability received in corresponding International Application No. PCT/JP2015/074544 dated May 18, 2017.
(Continued)

*Primary Examiner* — Abiy Teka
(74) *Attorney, Agent, or Firm* — Mattingly & Malur, PC

(57) ABSTRACT

A work machine including a specific actuator that supplies hydraulic fluid from a plurality of hydraulic pumps includes: first and second hydraulic pumps communicating with a first hydraulic actuator; a first control valve returning hydraulic fluid delivered by the first hydraulic pump to a tank; and a load detection section that detects a load on the first hydrau-
(Continued)

lic actuator. A control valve drive section drives the first control valve such that a communication area between the first hydraulic pump and the tank is enlarged corresponding to an increase in the load on the first hydraulic actuator; and a flow rate control section, during supply of the hydraulic fluid from the first and second hydraulic pumps to the first hydraulic actuator, controls to reduce a delivery flow rate of the first hydraulic pump corresponding to an increase in the load on the first hydraulic actuator.

5 Claims, 8 Drawing Sheets

(51) Int. Cl.

| | |
|---|---|
| ***F15B 11/00*** | (2006.01) |
| ***F15B 11/17*** | (2006.01) |
| ***E02F 3/32*** | (2006.01) |
| ***F15B 11/10*** | (2006.01) |
| *E02F 9/08* | (2006.01) |

(52) U.S. Cl.

CPC ..... *E02F 9/2271* (2013.01); *E02F 9/2292* (2013.01); *F15B 11/00* (2013.01); *F15B 11/10* (2013.01); *F15B 11/17* (2013.01); *E02F 9/0883* (2013.01); *F15B 2211/20576* (2013.01); *F15B 2211/455* (2013.01); *F15B 2211/605* (2013.01); *F15B 2211/6346* (2013.01)

(56) References Cited

U.S. PATENT DOCUMENTS

| | | | | |
|---|---|---|---|---|
| 2015/0013320 | A1 | 1/2015 | Akiyama et al. | |
| 2015/0354167 | A1* | 12/2015 | Goto | E02F 3/32 414/685 |
| 2016/0138620 | A1* | 5/2016 | Terao | F15B 11/163 60/420 |

FOREIGN PATENT DOCUMENTS

| | | | |
|---|---|---|---|
| JP | 8-303407 | A | 11/1996 |
| JP | 11-303809 | A | 11/1999 |
| JP | 2000-337307 | A | 12/2000 |
| JP | 2004-76904 | A | 3/2004 |
| JP | 2014-020431 | A | 2/2014 |

OTHER PUBLICATIONS

International Search Report of PCT/JP2015/074544 dated Nov. 17, 2015.

Korean Office Action received in corresponding Korean Application No. 10-2017-7004741 dated Mar. 21, 2018.

Extended European Search Report received in corresponding European Application No. 15857003.6 dated Jul. 20, 2018.

* cited by examiner

HYDRAULIC CONTROL SYSTEM FOR WORK MACHINE

TECHNICAL FIELD

The present invention relates to a hydraulic control system for a work machine.

BACKGROUND ART

A known hydraulic control system is intended for a construction machine that is designed to achieve an even more increased speed of a specific actuator that can be driven through merging of hydraulic fluids from two hydraulic pumps. This construction machine includes an engine, variable displacement first and second hydraulic pumps driven by the engine, a specific actuator that can be driven through merging of the hydraulic fluid delivered from each of the first hydraulic pump and the second hydraulic pump, another actuator that is different from the specific actuator, and a third hydraulic pump that is driven by the engine to supply the hydraulic fluid for driving the another actuator. The hydraulic control system includes a merging valve that can merge the hydraulic fluid from the third hydraulic pump with the hydraulic fluid from the first hydraulic pump and the second hydraulic pump to thereby selectively supply the merged hydraulic fluid to the specific actuator and a merging cancellation valve that cancels the merging function of the merging valve (see, for example, Patent Document 1).

PRIOR ART DOCUMENT

Patent Document

Patent Document 1: JP-2000-337307-A

SUMMARY OF THE INVENTION

Problem to be Solved by the Invention

A hydraulic control circuit in the known hydraulic control system described above includes the merging cancellation valve that cancels the merging function of the merging valve. When load pressure on an arm cylinder is high, the merging cancellation valve is operated and delivery fluid of the third hydraulic pump is thereby returned from the merging valve to a tank, so that the delivery pressure of the third hydraulic pump is reduced. This reduces the load on the third hydraulic pump to thereby increase a delivery flow rate of other hydraulic pumps. As a result, a flow rate to be supplied to actuators including a bucket cylinder driven by other hydraulic pumps can be obtained, so that favorable combined operability can be achieved.

The hydraulic control circuit in the known art described above, however, has the following problem in terms of energy saving.

In general, since a leakage flow rate of a hydraulic pump increases with increasing delivery pressure, the leakage flow rate has a greater effect on total loss of the hydraulic pump at higher delivery pressure values. The merging cancellation valve is thus operated to correspond to the load pressure and the delivery pressure of the third hydraulic pump is thereby reduced. The leakage flow rate of all pumps can thereby be reduced. Unfortunately, however, the patent document of the known art does not describe flow rate control of the third hydraulic pump during this time.

Application of well-known positive control, for example, causes the third hydraulic pump to deliver a flow rate in accordance with an operation amount of an arm lever. This can increase likelihood that an inoperative flow rate representing the fluid returning to the tank without being supplied to the actuator increases. As a result, a waste of energy occurs.

The present invention has been made in view of the foregoing situation and it is an object of the present invention to provide, in a hydraulic control system for a work machine including a specific actuator to which hydraulic fluid can be supplied from a plurality of hydraulic pumps, an energy-saving hydraulic control system for a work machine.

Means for Solving the Problem

To achieve the foregoing object, an aspect of the present invention provides a hydraulic control system for a work machine including: a first hydraulic actuator; a first hydraulic pump and a second hydraulic pump capable of communicating with the first hydraulic actuator; a first control valve capable of returning a hydraulic fluid delivered by the first hydraulic pump to a tank; and a load detection section that detects a load on the first hydraulic actuator. The hydraulic control system includes: a control valve drive section that takes in a detection signal detected by the load detection section and drives the first control valve such that a communication area between the first hydraulic pump and the tank is enlarged corresponding to an increase in the load on the first hydraulic actuator; and a flow rate control section that, during supply of the hydraulic fluid from the first hydraulic pump and the second hydraulic pump to the first hydraulic actuator, takes in a detection signal detected by the load detection section and controls to reduce a delivery flow rate of the first hydraulic pump corresponding to an increase in the load on the first hydraulic actuator.

Effects of the Invention

In accordance with an aspect of the present invention, the delivery flow rate of the first hydraulic pump is decreased with an increasing load on the first hydraulic actuator to thereby drive the first control valve so as to enlarge the communication area between the first hydraulic pump and the tank, so that the delivery pressure of the first hydraulic pump can be reduced and a pump total leakage flow rate can be reduced. A void flow rate delivered from the first hydraulic pump can thus be reduced. As a result, an energy-saving hydraulic control system for a work machine can be provided.

MODES FOR CARRYING OUT THE INVENTION

A hydraulic control system for a work machine according to embodiments is described below with reference to the accompanying drawings.

First Embodiment

Figure 1:
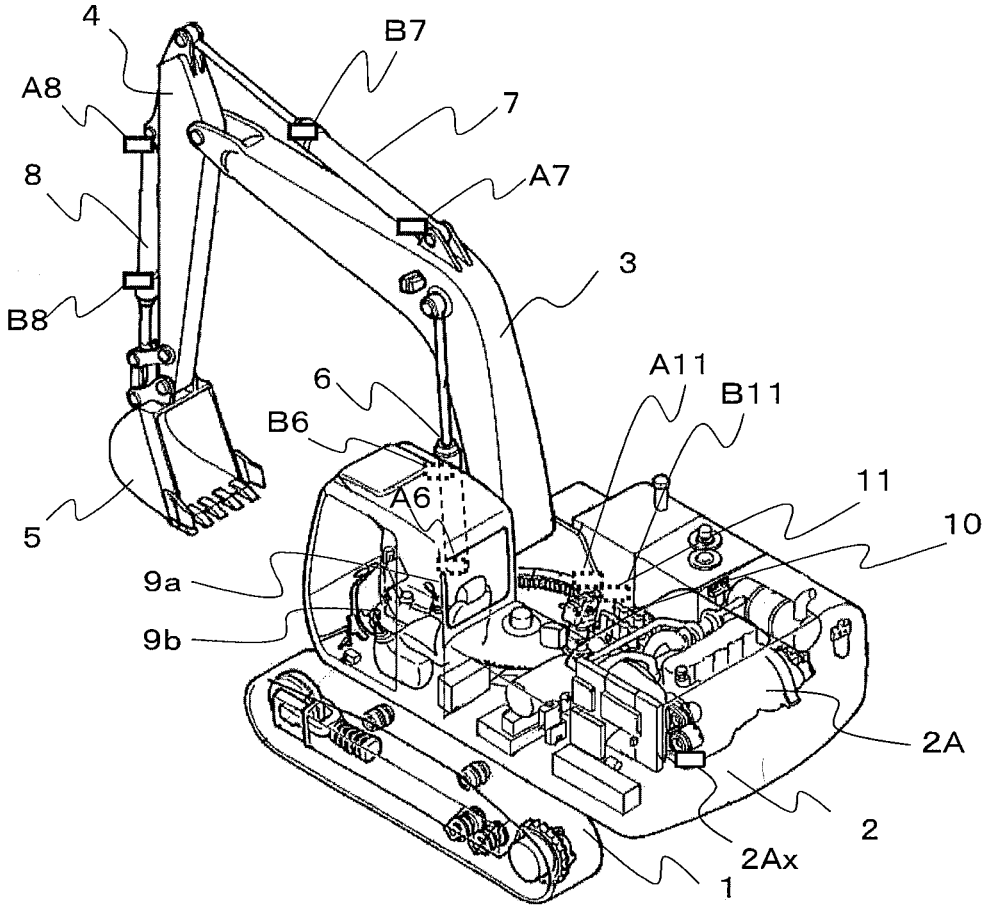
FIG. 1 is a perspective view of a work machine that includes a hydraulic control system for a work machine according to a first embodiment of the present invention.
Figure 2:
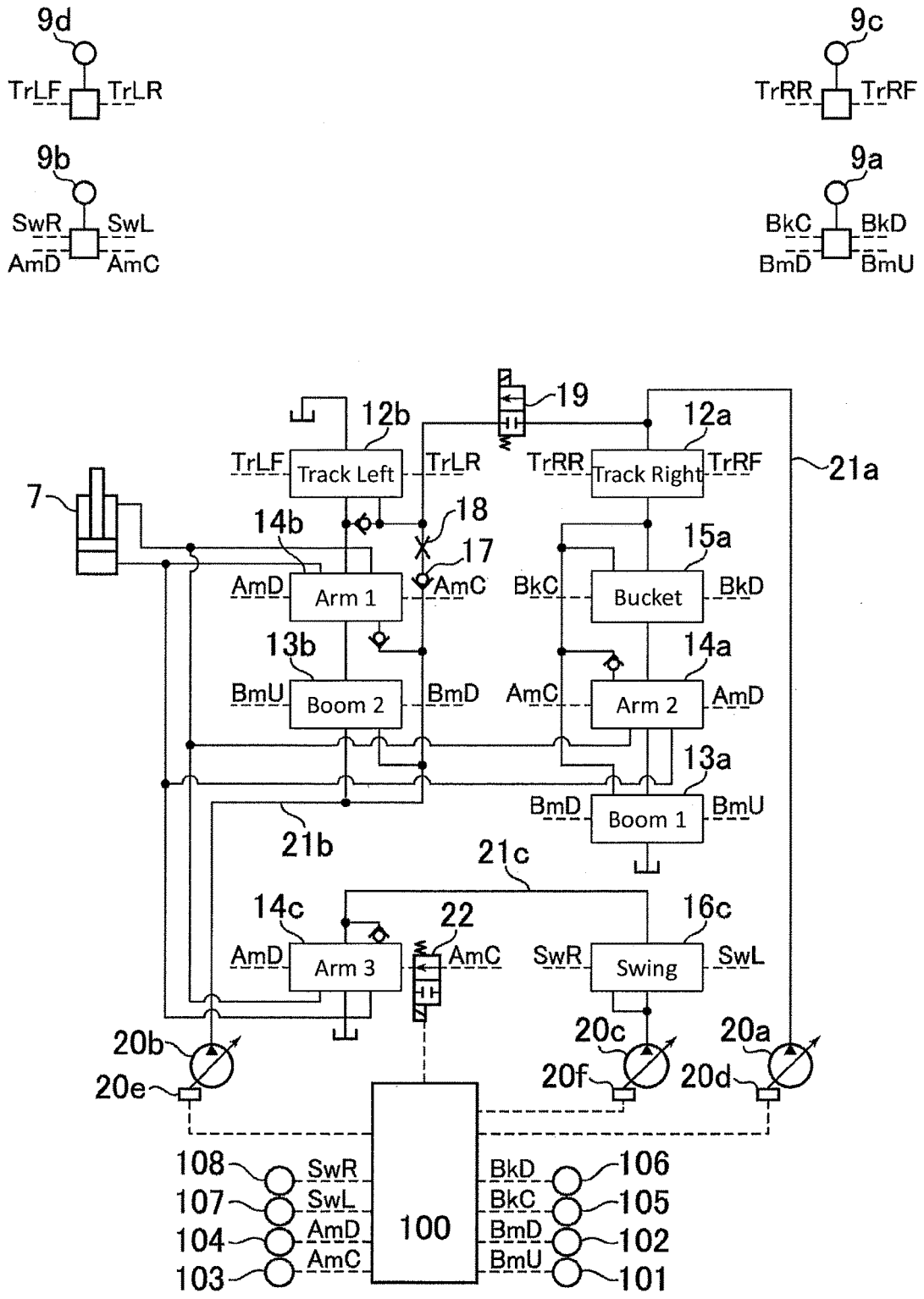
FIG. 2 is a hydraulic control circuit diagram of the hydraulic control system for a work machine according to the first embodiment.

FIG. 1 is a perspective view of a work machine that includes a hydraulic control system for a work machine according to a first embodiment of the present invention. FIG. 2 is a hydraulic control circuit diagram of the hydraulic control system for a work machine according to the first embodiment.

As shown in FIG. 1, a hydraulic excavator that includes the hydraulic control system for a work machine according to the first embodiment includes a lower track structure 1, an upper swing structure 2 disposed on the lower track structure 1, a front work implement connected to the upper swing structure 2 rotatably in a vertical direction, and an engine 2A as a prime mover. The front work implement includes a boom 3, an arm 4, and a bucket 5. Specifically, the boom 3 is installed to the upper swing structure 2. The arm 4 is installed to a distal end of the boom 3. The bucket 5 is installed to a distal end of the arm 4. In addition, the front work implement includes a pair of boom cylinders 6, an arm cylinder 7, and a bucket cylinder 8. Specifically, the boom cylinders 6 drive the boom 3. The arm cylinder 7 drives the arm 4. The bucket cylinder 8 drives the bucket 5.

The hydraulic excavator supplies hydraulic fluid delivered by a hydraulic pump unit not shown to the boom cylinders 6, the arm cylinder 7, the bucket cylinder 8, and a swing hydraulic motor 11 via a control valve 10 in accordance with an operation of a first control lever 9*a* or a second control lever 9*b* provided in a cabin of the upper swing structure 1. A cylinder rod of each of the boom cylinders 6, the arm cylinder 7, and the bucket cylinder 8 is extended and contracted by the hydraulic fluid, so that a position and posture of the bucket 5 can be varied. Additionally, the swing hydraulic motor 11 is rotated by the hydraulic fluid, so that the upper swing structure 2 swings with respect to the lower track structure 1.

The control valve 10 includes a track right directional control valve 12*a*, a track left directional control valve 12*b*, a boom first directional control valve 13*a*, a boom second directional control valve 13*b*, an arm first directional control valve 14*b*, an arm second directional control valve 14*a*, an arm third directional control valve 14*c*, a bucket directional control valve 15*a*, and a swing directional control valve 16*c* to be described later.

The engine 2A includes a speed sensor 2Ax that detects an engine speed. The boom cylinders 6 each include a pressure sensor A6 that detects pressure of a bottom-side fluid chamber and a pressure sensor B6 that detects pressure of a rod-side fluid chamber. The arm cylinder 7 includes a pressure sensor A7 that detects pressure of a bottom-side fluid chamber as a load acquisition part and a pressure sensor B7 that detects pressure of a rod-side fluid chamber. Similarly, the bucket cylinder 8 includes a pressure sensor A8 that detects pressure of a bottom-side fluid chamber and a pressure sensor B8 that detects pressure of a rod-side fluid chamber. The swing hydraulic motor 11 includes pressure sensors A11 and B11 that detect clockwise and counterclockwise swing pressures. Pressure signals detected by the pressure sensors A6 to A8, B6 to B8, A11, and B11 and the engine speed detected by the speed sensor 2Ax are applied to a controller 100 to be described later.

A pump system 20 that constitutes the hydraulic control system for a work machine according to the first embodiment includes, as shown in FIG. 2, a first hydraulic pump 20*a*, a second hydraulic pump 20*b*, and a third hydraulic pump 20*c* that are variable displacement type hydraulic pumps. The first to third hydraulic pumps 20*a* to 20*c* are driven by the engine 2A.

The first hydraulic pump 20*a* includes a regulator 20*d* that is driven by a command signal from the controller 100 to be described later and supplies a first pump line 21*a* with a controlled delivery flow rate of the hydraulic fluid. Similarly, the second hydraulic pump 20*b* includes a regulator 20*e* that is driven by a command signal from the controller 100 to be described later and supplies a second pump line 21*b* with a controlled delivery flow rate of the hydraulic fluid. Additionally, the third hydraulic pump 20*c* includes a regulator 20*f* that is driven by a command signal from the controller 100 to be described later and supplies a third pump line 21*c* with a controlled delivery flow rate of the hydraulic fluid.

For a simplified description, descriptions for, for example, relief valves, return circuits, and load check valves that are not directly connected with the present embodiment are omitted. Additionally, the present embodiment will be described for a case in which the present invention is applied to a well-known open center type hydraulic control system. The application is, however, illustrative only and not limiting.

The track right directional control valve 12*a*, the bucket directional control valve 15*a*, the arm second directional control valve 14*a*, and the boom first directional control valve 13*a* are disposed in the first pump line 21*a* that communicates with a delivery port of the first hydraulic pump 20*a*. The resultant configuration is a tandem circuit that prioritizes the track right directional control valve 12*a* and a parallel circuit with the remaining bucket directional control valve 15*a*, arm second directional control valve 14*a*, and boom first directional control valve 13*a*.

The boom second directional control valve 13*b*, the arm first directional control valve 14*b*, and the track left directional control valve 12*b* are disposed in the second pump line 21*b* that communicates with a delivery port of the second hydraulic pump 20*b*. The resultant configuration is a parallel circuit with the boom second directional control valve 13*b* and the arm first directional control valve 14*b* and a parallel-tandem circuit with the track left directional control valve 12*b*. A check valve 17 that permits inflow only from the second hydraulic pump 20*b* side and a restrictor 18 are disposed in the parallel circuit with the track left directional control valve 12*b*. Additionally, the track left directional control valve 12*b* can communicate with the first hydraulic pump 20 via a track communication valve 19.

The arm third directional control valve 14*c* and the swing directional control valve 16*c* are disposed in the third pump line 21*c* that communicates with a delivery port of the third hydraulic pump 20*c*. The resultant configuration is a tandem circuit that prioritizes the swing directional control valve 16*c*.

It is noted that an outlet port of the boom first directional control valve 13*a* and an outlet port of the boom second directional control valve 13*b* communicate with the boom cylinders 6 via a merging passage not shown. An outlet port of the arm second directional control valve 14*a*, an outlet port of the arm first directional control valve 14*b*, and an outlet port of the arm third directional control valve communicate with the arm cylinder 7 via a merging passage not shown. Additionally, an outlet port of the bucket directional control valve 15*a* communicates with the bucket cylinder 5 and an outlet port of the swing directional control valve 16*c* communicates with the swing hydraulic motor 11.

Reference is made to FIG. 2. The first control lever 9*a* to a fourth control lever 9*d* are each provided with pilot valves not shown thereinside. The pilot valves generate pilot pressure corresponding to an operation amount in a tilting operation of each control lever. The pilot pressure resulting from each control lever operation is supplied to an operating section of each directional control valve.

The pilot lines indicated by broken lines BkC and BkD from the first control lever 9*a* are connected with an operating section of the bucket directional control valve 15*a*. A bucket crowding pilot pressure and a bucket dumping pilot pressure generated corresponding to the operation amount in the tilting operation of the control lever are thus supplied. Additionally, a pilot line indicated by broken lines BmD and BmU from the first control lever 9*a* are connected with respective operating sections of the boom first directional control valve 13*a* and the boom second directional control valve 13*b*. A boom raising pilot pressure and a boom lowering pilot pressure generated corresponding to the operation amount in the tilting operation of the control lever are thus supplied.

A pressure sensor 105 and a pressure sensor 106 are provided in the pilot lines indicated by the broken lines BkC and BkD. The pressure sensor 105 detects the bucket crowding pilot pressure. The pressure sensor 106 detects the bucket dumping pilot pressure. A pressure sensor 101 and a pressure sensor 102 are provided in the pilot lines indicated by the broken lines BmD and BmU. The pressure sensor 101 detects the boom raising pilot pressure. The pressure sensor 102 detects the boom lowering pilot pressure. The pressure sensors 101, 102, 105, and 106 are each an operation instruction detection section. Pressure signals detected by the pressure sensors 101, 102, 105, and 106 are applied to the controller 100.

Pilot lines indicated by broken lines AmC and AmD from the second control lever 9*b* are connected with respective operating sections of the arm first directional control valve 14*b*, the arm second directional control valve 14*a*, and the arm third directional control valve 14*c*. An arm crowding pilot pressure and an arm dumping pilot pressure generated corresponding to the operation amount in the tilting operation of the control lever are thus supplied. Additionally, Pilot lines indicated by broken lines SwR and SwL from the second control lever 9*b* are connected with an operating section of the swing directional control valve 16*c*. A swing right pilot pressure and a swing left pilot pressure generated corresponding to the operation amount in the tilting operation of the control lever are thus supplied.

A pressure sensor 103 and a pressure sensor 104 are provided in the pilot lines indicated by the broken lines AmC and AmD. The pressure sensor 103 detects the arm crowding pilot pressure. The pressure sensor 104 detects the arm dumping pilot pressure. Additionally, an arm 3 crowding pressure reducing valve 22 is provided in an arm crowding pilot line connected with the operating section of the arm third directional control valve 14*c*. The arm 3 crowding pressure reducing valve 22 limits or interrupts an arm crowding pilot hydraulic fluid to be supplied.

A pressure sensor 108 and a pressure sensor 107 are provided in the pilot lines indicated by the broken lines SwR and SwL. The pressure sensor 108 detects the swing right pilot pressure. The pressure sensor 107 detects the swing left pilot pressure. The pressure sensors 103, 104, 107, and 108 are each an operation instruction detection section. Pressure signals detected by the pressure sensors 103, 104, 107, and 108 are applied to the controller 100.

Pilot lines indicated by broken lines TrRF and TrRR from the third control lever 9*c* are connected with an operating section of the track right directional control valve 12*a*. A track right forward pilot pressure and a track right reverse pilot pressure generated corresponding to the operation amount in the tilting operation of the control lever are thus supplied.

Pilot lines indicated by broken lines TrLF and TrLR from the fourth control lever 9*d* are connected with an operating section of the track left directional control valve 12*b*. A track left forward pilot pressure and a track left reverse pilot pressure generated corresponding to the operation amount in the tilting operation of the control lever are thus supplied.

The hydraulic control system in the present embodiment includes the controller 100. The controller 100 receives an input of the engine speed from the speed sensor 2Ax shown in FIG. 1 and receives inputs of pilot line pilot pressure signals from the respective pressure sensors 101 to 108 described above. Additionally, the controller 100 receives inputs of actuator pressure signals from the respective pressure sensors A6 to A8, B6 to B8, A11, and B11 shown in FIG. 1.

The controller 100 outputs command signals to the regulator 20*d* of the first hydraulic pump 20*a*, the regulator 20*e* of the second hydraulic pump 20*b*, and the regulator 20*f* of the third hydraulic pump 20*c*, respectively, to thereby control delivery flow rates to the respective hydraulic pumps 20*a* to 20*c*. The controller 100 also outputs a command signal to an operating section of the arm 3 crowding pressure reducing valve 22 to thereby control to limit or interrupt pressure of an arm crowding pilot line Amc to be supplied to the operating section of the arm third directional control valve 14*c*. An increase in the command signal interrupts the pilot pressure supplied to the operating section of the arm third directional control valve 14*c*. As a result, communication between the third hydraulic pump 20*c* and the arm cylinder 7 is interrupted and the hydraulic fluid from the third pump line 21*c* is returned to the tank.

Figure 3:
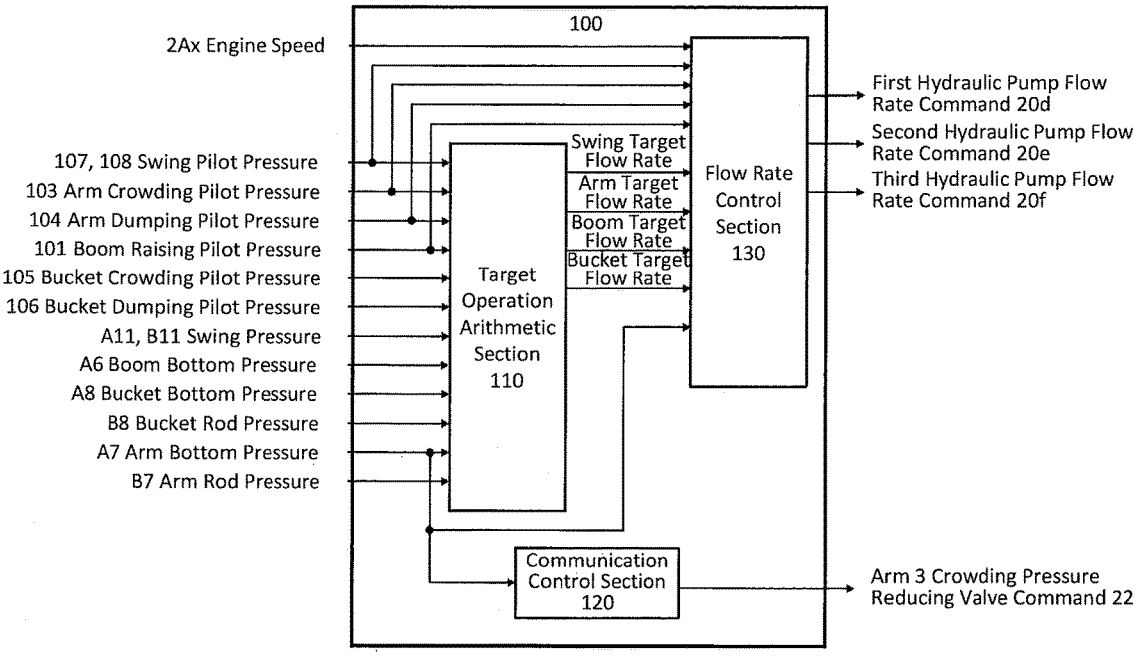
FIG. 3 is a conceptual diagram of a configuration of a controller that constitutes the hydraulic control system for a work machine according to the first embodiment.
Figure 4:
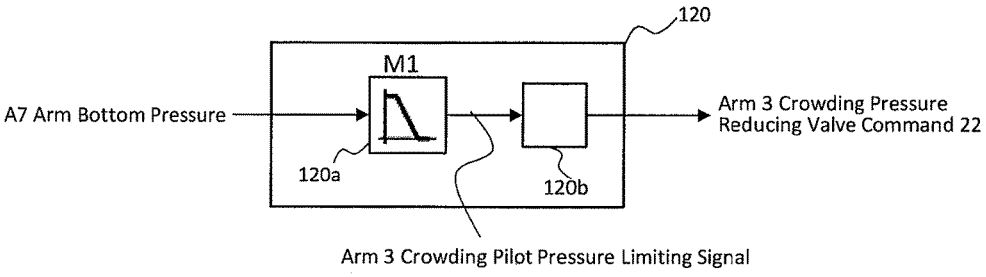
FIG. 4 is a characteristic diagram representing an exemplary map used for arithmetic operations performed by a target operation arithmetic section of the controller that constitutes the hydraulic control system for a work machine according to the first embodiment.
Figure 5:
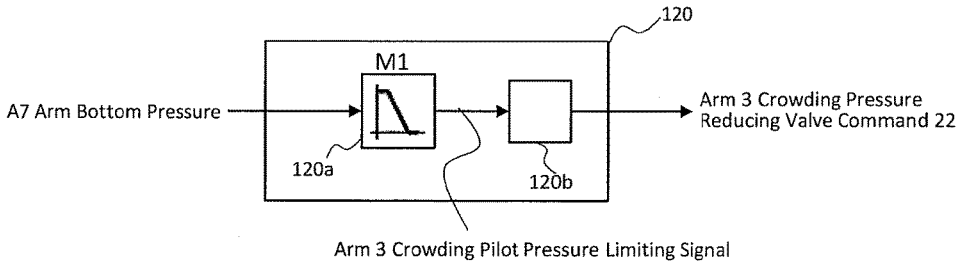
FIG. 5 is a control block diagram representing exemplary arithmetic operations performed by a communication control section of the controller that constitutes the hydraulic control system for a work machine according to the first embodiment.

The controller that constitutes the hydraulic control system for a work machine according to the first embodiment is described below with reference to relevant drawings. FIG. 3 is a conceptual diagram of a configuration of the controller that constitutes the hydraulic control system for a work machine according to the first embodiment. FIG. 4 is a characteristic diagram representing an exemplary map for use by a target operation arithmetic section of the controller that constitutes the hydraulic control system for a work machine according to the first embodiment. FIG. 5 is a control block diagram representing exemplary arithmetic operations performed by a communication control section of the controller that constitutes the hydraulic control system for a work machine according to the first embodiment.

Reference is made to FIG. 3. The controller 100 includes a target operation arithmetic section 110, a communication control section 120, and a flow rate control section 130. Specifically, the target operation arithmetic section 110 calculates a target flow rate using each pilot pressure and each load pressure. The communication control section 120 serves as a communication control section that calculates a command signal for the arm 3 crowding pressure reducing valve 22 for controlling a communication state of the control valve 10. The flow rate control section 130 serves as a pump flow rate control section that calculates, on the basis of the target flow rates calculated by the target operation arithmetic section 110 and the engine speed from the speed sensor 2Ax, flow rate command signals of the respective first to third hydraulic pumps 20*a* to 20*c*. The flow rate control section 130 outputs command signals to the respective regulators 20*d* to 20*f* of the respective hydraulic pumps to thereby control the delivery flow rates of the respective first to third hydraulic pumps 20*a* to 20*c*.

The target operation arithmetic section 110 calculates each target flow rate such that the target flow rate increases with an increasing pilot pressure applied thereto and such that the target flow rate decreases with an increasing load pressure applied thereto. During combined operation, each target flow rate is calculated so as to be smaller than during single operation.

Exemplary calculations performed by the target operation arithmetic section 110 are described with reference to FIG. 4 and expressions. The target operation arithmetic section 110 stores, for each actuator, a map used for calculating a reference flow rate from a pilot pressure and shown in FIG. 4. For example, a swing target flow rate Qsw is calculated from a swing pilot pressure that represents a value applicable when maximum values of the swing right pilot pressure and the swing left pilot pressure are selected. Similarly, an arm crowding reference flow rate Qamc0 is calculated from the arm crowding pilot pressure and a dumping reference flow rate Qamd0 is calculated from the arm dumping pilot pressure.

A boom raising reference flow rate Qbmu0 is calculated from the boom raising pilot pressure. A bucket crowding reference flow rate Qbkc0 is calculated from the bucket crowding pilot pressure and a bucket dumping reference flow rate Qbkd0 is calculated from the bucket dumping pilot pressure.

The target operation arithmetic section 110 calculates a boom target flow rate Qbm from the swing target flow rate Qsw using an arithmetic expression, Expression 1.

Expression 1

$$Q_{bm}=\min(Q_{bm0}, Q_{bmmax}-k_{swbm}\cdot Q_{sw}) \quad (1)$$

Where, the symbol Qbmmax denotes a boom flow rate upper limit value and is set to correspond with a maximum speed of boom raising. The symbol kswbm denotes a boom flow rate reduction coefficient and the boom target flow rate Qbm decreases with an increasing swing target flow rate Qsw. It is noted that, instead of using the boom flow rate reduction coefficient kswbm, a map that causes the boom flow rate upper limit value Qbmmax to decrease with an increasing swing target flow rate Qsw may be used.

The target operation arithmetic section 110 uses arithmetic expressions, Expression 2 and Expression 3, to calculate swing drive power Lsw and boom drive power Lbm.

Expression 2

$$L_{sw}=P_{sw}\cdot Q_{sw} \quad (2)$$

Expression 3

$$L_{bm}=P_{bmb}\cdot Q_{bm} \quad (3)$$

Where, the symbol Psw denotes a swing pressure and represents a value of the pressure on a meter-in side selected from among the swing left pressure and the swing right pressure detected by the pressure sensors A11 and B11. The symbol Pbmb denotes a boom bottom pressure and represents the pressure of the bottom-side fluid chamber of the boom cylinder 6 detected by the pressure sensor A6.

The target operation arithmetic section 110 uses arithmetic expressions, Expression 4 and Expression 5, to calculate a bucket drive power upper limit value Lbkmax and an arm drive power upper limit value Lammax.

Expression 4

$$L_{bk\ max}=k_{bk}(L_{max}-L_{sw}-L_{bm}) \quad (4)$$

Expression 5

$$L_{am\ max}=k_{am}(L_{max}-L_{sw}-L_{bm}) \quad (5)$$

Where, the symbol Lmax denotes a total drive power upper limit value of the system. The symbol kbk denotes a bucket drive power coefficient and the symbol kam denotes an arm drive power coefficient. The bucket drive power coefficient kbk and the arm drive power coefficient kam are calculated using a bucket crowding pilot pressure BkC, a bucket dumping pilot pressure BkD, an arm crowding pilot pressure AmC, an arm dumping pilot pressure AmD, and an arithmetic expression Expression 6.

Expression 6

$$k_{bk}:k_{am}=\max(BkC,BkD):\max(AmC,AmD) \quad (6)$$

The target operation arithmetic section 110 uses the bucket crowding reference flow rate Qbkc0, the bucket dumping reference flow rate Qbkd0, the bucket drive power upper limit Lbkmax, and an arithmetic expression Expression 7 to calculate a bucket target flow rate Qbk. Additionally, the target operation arithmetic section 110 uses the arm crowding reference flow rate Qamc0, the arm dumping reference flow rate Qamd0, the arm drive power upper limit Lammax, and an arithmetic expression Expression 8 to calculate an arm target flow rate Qam.

Expression 7

$$Q_{bk}=\min(Q_{bkc0}, Q_{bkd0}, L_{bk\ max}/P_{bk}) \quad (7)$$

Expression 8

$$Q_{am}=\min(Q_{amc0}, Q_{amd0}, L_{am\ max}/P_{am}) \quad (8)$$

Where, the symbol Pbk denotes a value of the pressure on a meter-in side selected from among the bottom-side fluid chamber pressure and the rod-side fluid chamber pressure of the bucket cylinder 8 detected by the pressure sensors A8 and B8. The symbol Pam denotes a value of the pressure on a meter-in side selected from among the bottom-side fluid chamber pressure and the rod-side fluid chamber pressure of the arm cylinder 7 detected by the pressure sensors A7 and B7.

Exemplary calculations performed by the communication control section 120 are described below with reference to FIG. 5. The communication control section 120 includes a first function generating section 120*a* and a solenoid valve drive command converting section 120*b*.

As shown in FIG. 5, the first function generating section 120*a* receives an input of the bottom-side fluid chamber pressure of the arm cylinder 7 detected by the pressure sensor A7. The first function generating section 120*a* stores therein in advance as a map M1 a table that indicates a limiting characteristic of the arm 3 crowding pilot pressure with respect to the bottom-side fluid chamber pressure of the arm cylinder 7. The map M1 exhibits a characteristic that the arm 3 crowding pilot pressure decreases with an increasing bottom-side fluid chamber pressure of the arm cylinder 7. An arm 3 crowding pilot pressure limiting characteristic signal calculated by the first function generating section 120*a* is output to the solenoid valve drive command converting section 120*b*.

The solenoid valve drive command converting section 120*b* receives the input of the arm 3 crowding pilot pressure limiting characteristic signal from the first function generating section 120*a* and calculates a command signal for the arm 3 crowding pressure reducing valve 22 corresponding to the limiting characteristic signal. Specifically, an increase in the command signal for the arm 3 crowding pressure reducing valve 22 reduces and interrupts the pilot pressure supplied to the operating section of the arm third directional control valve 14*c*, so that the characteristic is such that an output signal increases with an increasing input signal. The command signal calculated by the solenoid valve drive command converting section 120*b* is output to the operating section of the arm 3 crowding pressure reducing valve 22.

Thus, the pilot pressure supplied to the operating section of the arm third directional control valve 14*c* is reduced more with higher bottom-side fluid chamber pressures of the arm cylinder 7.

It is here noted that, in the limiting characteristic of the arm 3 crowding pilot pressure, the value of pressure starting to decrease from a certain value in the bottom-side fluid chamber of the arm cylinder 7 is preferably set to be equal to or higher than a pump delivery pressure at which leakage loss of the hydraulic pump is likely to exceed friction loss of the hydraulic pump and is set on the basis of the loss characteristic of the hydraulic pump.

Figure 6:
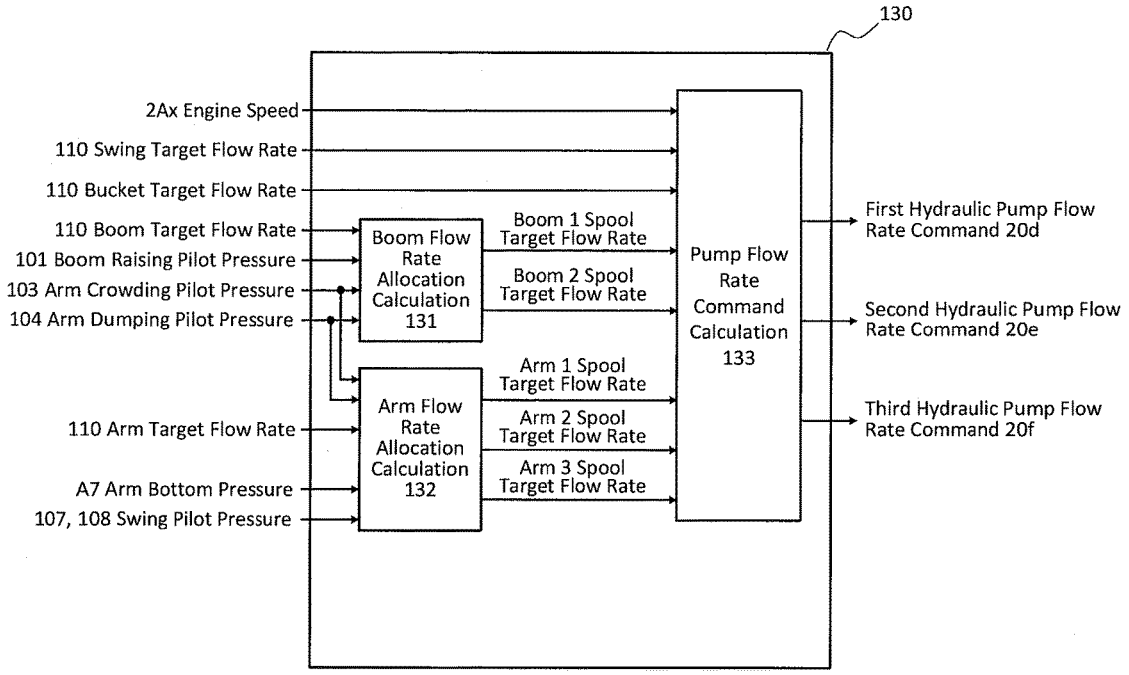
FIG. 6 is a conceptual diagram of a configuration of a flow rate control section of the controller that constitutes the hydraulic control system for a work machine according to the first embodiment.
Figure 7:
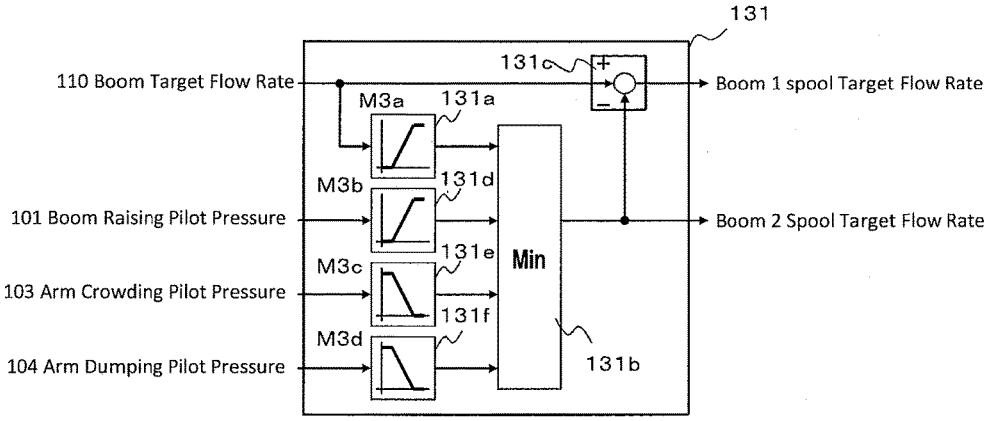
FIG. 7 is a control block diagram representing exemplary arithmetic operations performed by a boom flow rate allocation arithmetic section of the controller that constitutes the hydraulic control system for a work machine according to the first embodiment.
Figure 8:
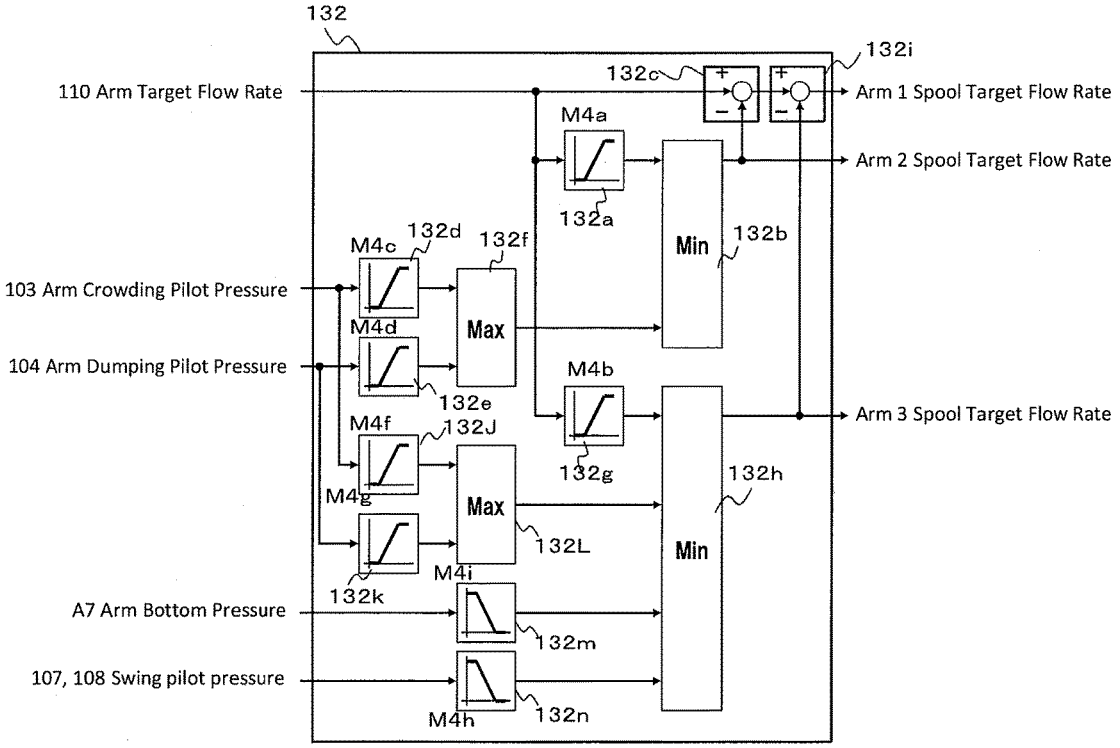
FIG. 8 is a control block diagram representing exemplary arithmetic operations performed by an arm target flow rate allocation arithmetic section of the controller that constitutes the hydraulic control system for a work machine according to the first embodiment.
Figure 9:
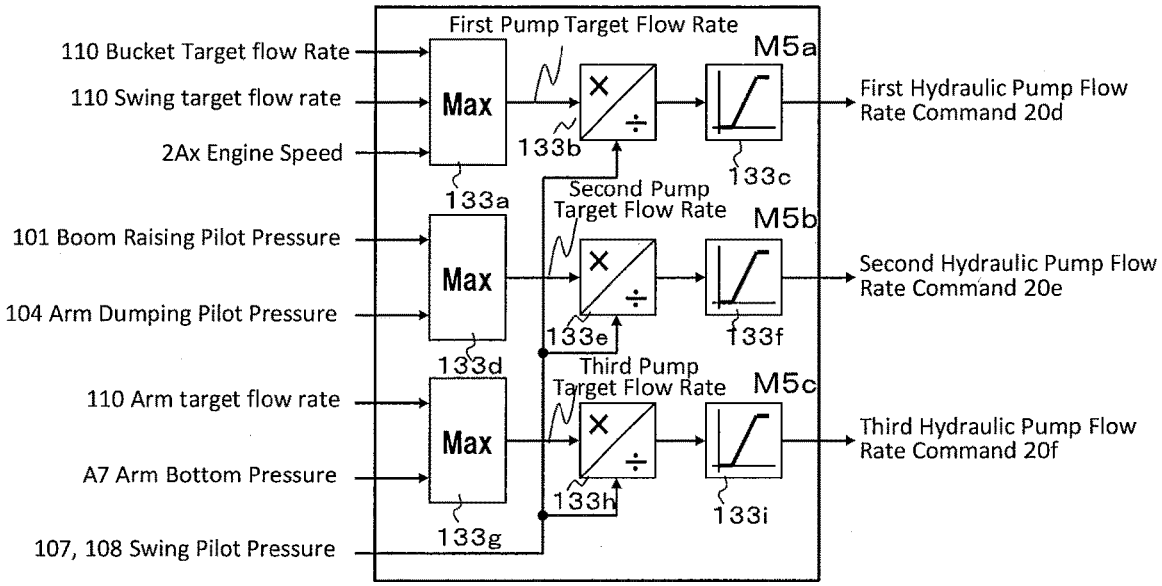
FIG. 9 is a control block diagram representing exemplary arithmetic operations performed by a pump flow rate command arithmetic section of the controller that constitutes the hydraulic control system for a work machine according to the first embodiment.

The flow rate control section 130 as a pump flow rate control section is described below with reference to relevant drawings. FIG. 6 is a conceptual diagram of a configuration of the flow rate control section of the controller that constitutes the hydraulic control system for a work machine according to the first embodiment. FIG. 7 is a control block diagram representing exemplary arithmetic operations performed by a boom flow rate allocation arithmetic section of the controller that constitutes the hydraulic control system for a work machine according to the first embodiment. FIG. 8 is a control block diagram representing exemplary arithmetic operations performed by an arm target flow rate allocation arithmetic section of the controller that constitutes the hydraulic control system for a work machine according to the first embodiment. FIG. 9 is a control block diagram representing exemplary arithmetic operations performed by a pump flow rate command arithmetic section of the controller that constitutes the hydraulic control system for a work machine according to the first embodiment. In FIGS. 6 to 9, like or corresponding elements are identified by the same reference numerals as those used in FIGS. 1 to 5 and descriptions for those elements are omitted.

Reference is made to FIG. 6. The flow rate control section 130 includes a boom flow rate allocation arithmetic section 131, an arm flow rate allocation arithmetic section 132, and a pump flow rate command arithmetic section 133. Specifically, the boom flow rate allocation arithmetic section 131 calculates an allocation of a target flow rate for each of the directional control valves of the boom 3. The arm flow rate allocation arithmetic section 132 calculates an allocation of a target flow rate for each of the directional control valves of the arm 4. The pump flow rate command arithmetic section 133 calculates the flow rate of each pump on the basis of the calculated target flow rate allocation and outputs command signals to the respective regulators 20*d* to 20*f* of the respective hydraulic pumps to thereby control the delivery flow rates of the respective first to third hydraulic pumps 20*a* to 20*c*.

Exemplary calculations performed by the boom flow rate allocation arithmetic section 131 are described below with reference to FIG. 7. The boom flow rate allocation arithmetic section 131 includes a first function generating section 131*a*, a minimum value selecting section 131*b*, a subtractor 131*c*, a second function generating section 131*d*, a third function generating section 131*e*, and a fourth function generating section 131*f*.

The first function generating section 131*a* receives an input of the boom target flow rate from the target operation arithmetic section 110. The first function generating section 131*a* stores therein in advance as a map M3*a* a table that indicates a boom 2 spool target flow rate with respect to the boom target flow rate. The map M3*a* exhibits a characteristic that the boom 2 spool target flow rate increases with an increasing boom target flow rate. The boom 2 spool target flow rate may be set, for example, to half of the boom target flow rate. In this case, a boom 1 spool target flow rate and the boom 2 spool target flow rate are each half of the boom target flow rate, unless the limiting to be described later is imposed. The calculated boom 2 spool target flow rate signal is output to the minimum value selecting section 131*b*.

The minimum value selecting section 131*b* receives inputs of the boom 2 spool target flow rate signal from the first function generating section 131*a*, a signal from the second function generating section 131*d* to be described later, a limiting signal from the third function generating section 131*e* to be described later, and a limiting signal from the fourth function generating section 131*f* to be described later. The minimum value selecting section 131*b* calculates a minimum value among these signals and outputs the minimum value as the boom 2 spool target flow rate to the subtractor 131*c* and the pump flow rate command arithmetic section 133.

The subtractor 131*c* receives inputs of the boom target flow rate from the target operation arithmetic section 110 and the boom 2 spool target flow rate from the minimum value selecting section 131*b*. The subtractor 131*c* then subtracts the boom 2 spool target flow rate from the boom target flow rate to thereby find the boom 1 spool target flow rate. The subtractor 131*c* outputs the calculated boom 1 spool target flow rate signal to the pump flow rate command arithmetic section 133.

The second function generating section 131*d* receives an input of the boom raising pilot pressure detected by the pressure sensor 101 and outputs a limiting signal to the minimum value selecting section 131*b*. The second function generating section 131*d* stores therein in advance as a map M3*b* a table that indicates an upper limit value of the boom 2 spool target flow rate with respect to the boom raising pilot pressure. The map M3*b* exhibits a trend of substantially proportional to a meter-in opening characteristic of the boom second directional control valve 13*b*, increasing with the boom raising pilot pressure. Specifically, the second function generating section 131*d* increases the upper limit value of the boom 2 spool target flow rate corresponding to the opening in the boom second directional control valve 13*c*.

The third function generating section 131*e* receives an input of the arm crowding pilot pressure detected by the pressure sensor 103 and outputs to the minimum value selecting section 131*b* a signal obtained from a map M3*c* stored in advance as a table. The map M3*c* exhibits a trend of substantially proportional to a meter-in opening characteristic of the arm first directional control valve 14*b* with respect to the arm crowding pilot pressure, reducing the upper limit of the boom 2 spool flow rate corresponding to the arm crowding pilot pressure.

The fourth function generating section 131*f* receives an input of the arm dumping pilot pressure detected by the pressure sensor 104 and outputs to the minimum value selecting section 131*b* a signal obtained from a map M3*d* stored in advance as a table. The map M3*d* exhibits a trend of substantially proportional to a meter-in opening characteristic of the arm first directional control valve 14*b* with respect to the arm dumping pilot pressure, reducing the upper limit value of the boom 2 spool flow rate corresponding to the arm dumping pilot pressure.

The boom flow rate allocation arithmetic section 131 limits the boom 2 spool target flow rate using these boom 2 spool flow rate upper limit values and subtracts the boom 2 spool target flow rate from the boom target flow rate to find the boom 1 spool target flow rate.

Exemplary calculations performed by the arm flow rate allocation arithmetic section 132 are described below with reference to FIG. 8. The arm flow rate allocation arithmetic section 132 includes a first function generating section 132*a*, a first minimum value selecting section 132*b*, a first subtractor 132*c*, a second function generating section 132*d*, a third function generating section 132*e*, a first maximum value selecting section 132*f*, a fourth function generating section 132*g*, a second minimum value selecting section 132*h*, a second subtractor 132*i*, a fifth function generating section 132J, a sixth function generating section 132*k*, a second maximum value selecting section 132L, a seventh function generating section 132*m*, and an eighth function generating section 132*n*.

The first function generating section 132*a* and the fourth function generating section 132*g* each receive an input of the arm target flow rate from the target operation arithmetic section 110. The first function generating section 132*a* stores therein in advance as a map M4*a* a table that indicates an arm 2 spool target flow rate with respect to the arm target flow rate. The fourth function generating section 132*g* stores therein in advance as a map M4*b* a table that indicates an arm 3 spool target flow rate with respect to the arm target flow rate. The maps M4*a* and M4*b* each exhibit a characteristic that the arm 2 spool target flow rate and the arm 3 spool target flow rate increase with an increasing arm target flow rate. Here, for example, each of the arm 2 spool target flow rate and the arm 3 spool target flow rate may be set to ⅓ of the arm target flow rate. In this case, the arm 1 spool target flow rate, the arm 2 spool target flow rate, and the arm 3 spool target flow rate are each ⅓ of the arm target flow rate, unless the limiting to be described later is imposed. The calculated arm 2 spool target flow rate signal is output to the first minimum value selecting section 132*b*. The calculated arm 3 spool target flow rate signal is output to the second minimum value selecting section 132*h*.

The first minimum value selecting section 132*b* receives inputs of the arm 2 spool target flow rate signal from the first function generating section 132*a* and a limiting signal from the first maximum value selecting section 132*f* to be described later. The first minimum value selecting section 132*b* calculates a minimum value of these signals and outputs the minimum value as an arm 2 spool target flow rate signal to the first subtractor 132*c* and the pump flow rate command arithmetic section 133.

The first subtractor 132*c* receives inputs of the arm target flow rate from the target operation arithmetic section 110 and the arm 2 spool target flow rate from the first minimum value selecting section 132*b*. The first subtractor 132*c* subtracts the arm 2 spool target flow rate from the arm target flow rate to thereby find an arm 1 spool target flow rate reference signal. The calculated arm 1 spool target flow rate reference signal is output to the second subtractor 132*i*.

The second function generating section 132*d* receives an input of the arm crowding pilot pressure detected by the pressure sensor 103 and outputs to the first maximum value selecting section 132*f* a signal obtained from a map M4*c* stored in advance as a table. The map M4*c* exhibits a trend of substantially proportional to a meter-in opening characteristic of the arm second directional control valve 14*a* with respect to the arm crowding pilot pressure, increasing the upper limit value of the arm 2 spool flow rate corresponding to the arm crowding pilot pressure.

The third function generating section 132*e* receives an input of the arm dumping pilot pressure detected by the pressure sensor 104 and outputs to the first maximum value selecting section 132*f* a signal obtained from a map M4*d* stored in advance as a table. The map M4*d* exhibits a trend of substantially proportional to a meter-in opening characteristic of the arm second directional control valve 14*a* with respect to the arm dumping pilot pressure, increasing the upper limit value of the arm 2 spool flow rate corresponding to the arm dumping pilot pressure.

The first maximum value selecting section 132*f* receives inputs of an output from the second function generating section 132*d* and an output from the third function generating section 132*e*. The first maximum value selecting section 132*f* calculates a maximum value of these outputs and outputs the maximum value to the first minimum value selecting section 132*b*.

The second minimum value selecting section 132*h* receives inputs of an arm 3 spool target flow rate signal from the fourth function generating section 132*g*, a limiting signal from the second maximum value selecting section 132L to be described later, and limiting signals from the seventh function generating section 132*m* and the eighth function generating section 132*n*. The second minimum value selecting section 132*h* calculates a minimum value of these signals and outputs the minimum value as an arm 3 spool target flow rate signal to the second subtractor 132*i* and the pump flow rate command arithmetic section 133.

The second subtractor 132*i* receives inputs of the arm 1 spool target flow rate reference signal calculated by the first subtractor 132*c* and the arm 3 spool target flow rate from the second minimum value selecting section 132*h*. The second subtractor 132*i* subtracts the arm 3 spool target flow rate from the arm 1 spool target flow rate reference signal to thereby calculate the arm 1 spool target flow rate reference signal. The calculated arm 1 spool target flow rate signal is output to the pump flow rate command arithmetic section 133.

The fifth function generating section 132J receives an input of the arm crowding pilot pressure detected by the pressure sensor 103 and outputs to the second maximum value selecting section 132L a signal obtained from a map M4*f* stored in advance as a table. The map M4*f* exhibits a trend of substantially proportional to a meter-in opening characteristic of the arm third directional control valve 14*c* with respect to the arm crowding pilot pressure, increasing the upper limit value of the arm 3 spool flow rate corresponding to the arm crowding pilot pressure. It is noted that, as compared with the characteristic of the map M4*c*, the characteristic of the map M4*f* is such that the output rises with a higher input value (arm crowding pilot pressure). This arrangement results in the following. Specifically, when the operation amount of the second control lever 9*b* that operates the arm 4 is small, the arm 2 spool target flow rate signal is first generated and, after the operation amount of the second control lever 9*b* that operates the arm 4 increases, the arm 3 spool target flow rate signal is generated.

The sixth function generating section 132*k* receives an input of the arm dumping pilot pressure detected by the pressure sensor 104 and outputs to the second maximum value selecting section 132L a signal obtained from a map M4*g* stored in advance as a table. The map M4*g* exhibits a trend of substantially proportional to a meter-in opening characteristic of the arm third directional control valve 14*c* with respect to the arm dumping pilot pressure, increasing the upper limit value of the arm 3 spool flow rate corresponding to the arm dumping pilot pressure. It is noted that, as compared with the characteristic of the map M4*d*, the characteristic of the map M4*g* is such that the output rises with a higher input value (arm dumping pilot pressure). This arrangement results in the following. Specifically, when the operation amount of the second control lever 9*b* that operates the arm 4 is small, the arm 2 spool target flow rate signal is first generated and, after the operation amount of the second control lever 9*b* increases, the arm 3 spool target flow rate signal is generated.

The second maximum value selecting section 132L receives inputs of an output from the fifth function generating section 132J and an output from the sixth function generating section 132*k*. The second maximum value selecting section 132L calculates a maximum value of these outputs and outputs the maximum value to the second minimum value selecting section 132*h*.

The seventh function generating section 132*m* receives an input of the bottom-side fluid chamber pressure of the arm cylinder 7 detected by the pressure sensor A7 and outputs to the second minimum value selecting section 132*h* a signal obtained from a map M4*i* stored in advance as a table. The map M4*i* is set, as is described later, such that the arm 3 spool flow rate upper limit value decreases corresponding to the bottom-side fluid chamber pressure of the arm cylinder 7.

The eighth function generating section 132*b* receives an input of a maximum value out of the swing right pilot pressure and the swing left pilot pressure detected by the pressure sensors 108 and 107, respectively, and outputs to the second minimum value selecting section 132*h* a signal obtained from a map M4*h* stored in advance as a table. The map M4*h* exhibits a trend of substantially proportional to a center bypass opening characteristic of the swing directional control valve 16*c* with respect to the swing pilot pressure, decreasing the upper limit value of the arm 3 spool flow rate corresponding to the swing pilot pressure.

The arm flow rate allocation arithmetic section 132 calculates the arm 1 spool target flow rate, the arm 2 spool target flow rate, and the arm 3 spool target flow rate on the basis of, for example, the arm target flow rate, the arm crowding pilot pressure, and the arm dumping pilot pressure calculated by the target operation arithmetic section 110. As described previously, however, because the rising point of the output with respect to the input is varied between the map M4*c* of the second function generating section 132*d* and the map M4*f* of the fifth function generating section 132J, and between the map M4*d* of the third function generating section 132*e* and the map M4*g* of the sixth function generating section 132*k*, the arm 1 spool target flow rate, the arm 2 spool target flow rate, and the arm 3 spool target flow rate are generated in sequence as the operation amount of the second control lever 9*b* that operates the arm 4 increases.

Thereafter, the arm 1 spool target flow rate and the arm 2 spool target flow rate are generated to correspond to the operation amount of the second control lever 9*b*. When the operation amount further increases, the arm 3 spool target flow rate is generated.

Exemplary calculations performed by the pump flow rate command arithmetic section 133 are described below with reference to FIG. 9. The pump flow rate command arithmetic section 133 includes a first maximum value selecting section 133*a*, a first divider 133*b*, a first function generating section 133*c*, a second maximum value selecting section 133*d*, a second divider 133*e*, a second function generating section 133*f*, a third maximum value selecting section 133*g*, a third divider 133*h*, and a third function generating section 133*i*.

The first maximum value selecting section 133*a* receives inputs of a bucket target flow rate signal from the target operation arithmetic section 110, a boom 1 spool target flow rate signal from the boom flow rate allocation arithmetic section 131, and an arm 2 spool target flow rate signal from the arm flow rate allocation arithmetic section 132. The first maximum value selecting section 133*a* then calculates a maximum value of these signals and outputs the maximum value as a first pump target flow rate to the first divider 133*b*.

The first divider 133*b* receives inputs of the first pump target flow rate from the first maximum value selecting section 133*a* and the engine speed detected by the speed sensor 2Ax. The first divider 133*b* then divides the first pump target flow rate by the engine speed to find a first pump target command. The calculated first pump target command signal is output to the first function generating section 133*c*.

The first function generating section 133*c* receives an input of the first pump target command signal calculated by the first divider 133*b*. The first function generating section 133*c* outputs as a first pump flow rate command signal a signal obtained from a map M5*a* stored in advance as a table to the regulator 20*d*. The delivery flow rate of the first hydraulic pump 20*a* is thereby controlled.

The second maximum value selecting section 133*d* receives inputs of a boom 2 spool target flow rate signal from the boom flow rate allocation arithmetic section 131 and an arm 1 spool target flow rate signal from the arm flow rate allocation arithmetic section 132. The second maximum value selecting section 133*d* then calculates a maximum value of these signals and outputs the maximum value as a second pump target flow rate to the second divider 133*e*.

The second divider 133*e* receives inputs of the second pump target flow rate from the second maximum value selecting section 133*d* and the engine speed detected by the speed sensor 2Ax. The second divider 133*e* then divides the second pump target flow rate by the engine speed to find a second pump target command. The calculated second pump target command signal is output to the second function generating section 133*f*.

The second function generating section 133*f* receives an input of the second pump target command signal calculated by the second divider 133*e*. The second function generating section 133*f* outputs as a second pump flow rate command signal a signal obtained from a map M5*b* stored in advance as a table to the regulator 20*e*. The delivery flow rate of the second hydraulic pump 20*b* is thereby controlled.

The third maximum value selecting section 133*g* receives inputs of a swing target flow rate signal from the target operation arithmetic section 110 and an arm 3 spool target flow rate signal from the arm flow rate allocation arithmetic section 132. The third maximum value selecting section 133*g* then calculates a maximum value of these signals and outputs the maximum value as a third pump target flow rate to the third divider 133*h*.

The third divider 133*h* receives inputs of the third pump target flow rate from the third maximum value selecting section 133*g* and the engine speed detected by the speed sensor 2Ax. The third divider 133*h* then divides the third pump target flow rate by the engine speed to find a third pump target command. The calculated third pump target command signal is output to the third function generating section 133*i*.

The third function generating section 133*i* receives an input of the third pump target command signal calculated by the third divider 133*b*. The third function generating section 133*i* outputs as a third pump flow rate command signal a signal obtained from a map M5*c* stored in advance as a table to the regulator 20*f*. The delivery flow rate of the third hydraulic pump 20*c* is thereby controlled.

In the pump flow rate command arithmetic section 133, the arm 2 spool target flow rate is input to the first maximum value selecting section 133*a*, the arm 1 spool target flow rate is input to the second maximum value selecting section 133*d*, and the arm 3 spool target flow rate is input to the third maximum value selecting section 133*g*, and the first pump target flow rate, the second pump target flow rate, and the third pump target flow rate are calculated, respectively. It is here noted that, in the arm flow rate allocation arithmetic section 132, as described previously, the arm 1 spool target flow rate is first generated, the arm 2 spool target flow rate is next generated, and the arm 3 spool target flow rate is finally generated corresponding to the increase in the operation amount of the second control lever 9*b* that operates the arm 4.

This results in the following when the second control lever 9*b* that operates the arm 4 is operated. Specifically, corresponding to the increase in the operation amount, the second pump flow rate command signal is first generated, the first pump flow rate command signal is next generated, and the third pump flow rate command signal is finally generated.

It is noted that the present embodiment has been described for a case in which a reduction ratio involved from the engine 2A to each hydraulic pump is 1. For any reduction ratio other than 1, calculations need to be performed corresponding to the applicable reduction ratio.

Figure 10:
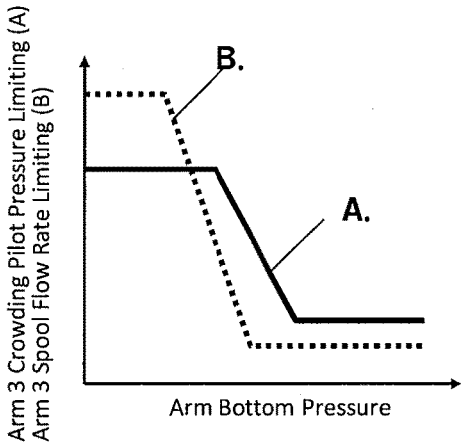
FIG. 10 is a characteristic diagram representing an exemplary map used for arithmetic operations performed by an arm flow rate allocation arithmetic section of the controller that constitutes the hydraulic control system for a work machine according to the first embodiment.

The setting of the map of the seventh function generating section 132*m* of the arm flow rate allocation arithmetic section 132 is described below with reference to FIG. 10. FIG. 10 is a characteristic diagram representing an exemplary map for use by the arm flow rate allocation arithmetic section of the controller that constitutes the hydraulic control system for a work machine according to the first embodiment.

In FIG. 10, the abscissa represents pressure of the bottom-side fluid chamber pressure of the arm cylinder 7 and the ordinate represents target flow rate of the arm 3 spool. Additionally, a characteristic line A indicated by the solid line represents the arm 3 crowding pilot pressure limiting characteristic signal of the map M1 set for the first function generating section 120*a* of the communication control section 120. A characteristic line B indicated by the broken line represents the map M4*i* set for the seventh function generating section 132*m*, indicating an upper limit limiting characteristic of the arm 3 spool target flow rate with respect to the bottom-side fluid chamber pressure of the arm cylinder 7.

Reference is made to FIG. 10. The map M4*i* (characteristic line B) decreases the arm 3 spool target flow rate upper limit value with an increasing bottom-side fluid chamber pressure of the arm cylinder 7, so that the map M4*i* has an operating direction identical to an operating direction of the map M1 (characteristic line A) that decreases the arm 3 crowding pilot pressure limiting characteristic with an increasing bottom-side fluid chamber pressure of the arm cylinder 7. The map M4*i* (characteristic line B) is, however, set to exhibit a characteristic that the reduction in the arm 3 spool target flow rate upper limit starts before the characteristic line A starts decreasing (in a region of small bottom-side fluid chamber pressures of the arm cylinder 7).

This arrangement results in the following. Specifically, when the bottom-side fluid chamber pressure of the arm cylinder 7 starts increasing, the arm 3 spool flow rate upper limit first decreases and the delivery flow rate of the third hydraulic pump 20*c* decreases; thereafter, the limiting characteristic of the arm 3 crowding pilot pressure causes the arm 3 crowding pressure reducing valve 22 to operate, so that the center bypass opening of the arm third directional control valve 14*c* starts opening. Thus, before the center bypass opening of the arm third directional control valve 14*c* opens, the arm 3 spool flow rate upper limit decreases and the delivery flow rate of the third hydraulic pump 20*c* decreases. As a result, bleed-off loss that is generated in the arm third directional control valve 14*c* can be reduced. Additionally, a small change results in the meter-in flow rate to the arm cylinder 7 at the start of opening of the center bypass opening of the arm third directional control valve 14*c*, so that shock at this time can be reduced.

Figure 11:
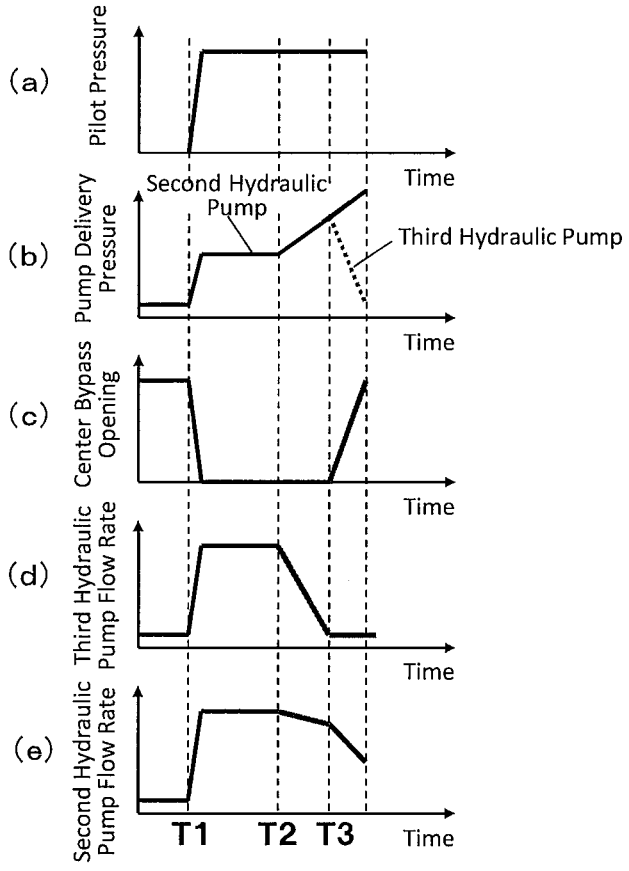
FIGS. 11(*a*) to 11(*e*) are characteristic diagrams illustrating exemplary operations relating to a pump flow rate control section in the hydraulic control system for a work machine according to the first embodiment.

Operations of the hydraulic control system for a work machine according to the first embodiment of the present invention are described below with reference to relevant drawings. FIGS. 11(*a*) to 11(*e*) are characteristic diagrams illustrating exemplary operations relating to the pump flow rate control section in the hydraulic control system for a work machine according to the first embodiment.

In FIGS. 11(*a*) to 11(*e*), the abscissa represents time and the ordinate represents pilot pressure in FIG. 11(*a*), hydraulic pump delivery pressure in FIG. 11(*b*), arm third directional control valve 14*c* enter bypass opening in FIG. 11(*c*), third hydraulic pump delivery flow rate in FIG. 11(*d*), and fourth hydraulic pump delivery flow rate in FIG. 11(*e*), respectively. In FIG. 11(*b*), the solid line represents a delivery pressure characteristic of the second hydraulic pump 20*b* and the broken line represents a delivery pressure characteristic of the third hydraulic pump 20*c*. In addition, time T1 represents time at which an arm crowding operation is started, time T2 represents time at which the bottom-side fluid chamber pressure of the arm cylinder 7 increases because of, for example, the bucket contacting an excavation surface, and time T3 represents time at which the bottom-side fluid chamber pressure of the arm cylinder 7 further increases, respectively. It is noted that, for simplification purposes, operations of the first hydraulic pump 20*a* are omitted.

When the arm crowding operation is started at time T1, the arm crowding pilot pressure rises as shown in FIG. 11(*a*). The arm first directional control valve 14*b* and the arm third directional control valve 14*c* then operate, the arm cylinder 7 communicates with each hydraulic pump, and the pump delivery pressure shown in FIG. 11(*b*) rises to pressure corresponding to the bottom-side fluid chamber pressure of the arm cylinder 7. If the bottom-side fluid chamber pressure of the arm cylinder 7 is low at this time, the center bypass opening of the arm third directional control valve 14*c* closes as shown in FIG. 11(*c*). Additionally, as shown in FIGS. 11(*d*) and 11(*e*), the delivery flow rate of the third hydraulic pump 20*c* and the delivery flow rate of the second hydraulic pump 20*b* increase and the arm 4 operates.

When the bottom-side fluid chamber pressure of the arm cylinder 7 increases because of, for example, the bucket 5 contacting an excavation surface at time T2, the flow rate control section 130 reduces the delivery flow rate of the third hydraulic pump 20*c* as shown in FIG. 11(*d*). At this time, the arm flow rate allocation arithmetic section 132 considerably reduces the delivery flow rate of the second hydraulic pump 20*b* to correspond to the bottom-side fluid chamber pressure of the arm cylinder 7, so that a reduction amount in the delivery flow rate of the second hydraulic pump 20*b* is small as shown in FIG. 11(*e*) and a total arm meter-in flow rate is maintained at the arm target flow rate.

When the bottom-side fluid chamber pressure of the arm cylinder 7 further increases thereafter to reach, at time T3, a pressure value at which the pressure starts decreasing from a certain value due to the limiting characteristic of the arm 3 crowding pilot pressure in the communication control section 120, the center bypass opening of the arm third directional control valve 14*c* starts opening as shown in FIG. 11(*c*) and the delivery pressure of the third hydraulic pump 20*c* starts decreasing as shown in FIG. 11(*b*). It is noted that, preferably, the delivery flow rate of the third hydraulic pump 20*c* after time T3 shown in FIG. 11(*d*) is a standby flow rate. Operating the third hydraulic pump 20*c* with the standby flow rate improves an energy saving effect.

The standby flow rate, as used in the present embodiment, refers to a minimum delivery flow rate of the hydraulic fluid that needs to be delivered in order to protect the hydraulic pump to be operated.

In general, the leakage flow rate of the hydraulic pump increases substantially in proportion to the delivery pressure and the leakage flow rate has a greater effect on the loss of the hydraulic pump at higher delivery pressure values. Thus, under high load conditions, driving the arm cylinder 7 using only the second hydraulic pump 20*b* as in the hydraulic control system according to the present embodiment can minimize a total pump loss to thereby achieve energy saving, rather than driving the arm cylinder 7 using both the third hydraulic pump 20*c* and the second hydraulic pump 20*b*.

Additionally, the delivery flow rate of the third hydraulic pump 20*c* is reduced before the center bypass opening of the arm third directional control valve 14*c* starts opening. This reduces the bleed-off loss generated in the arm third directional control valve 14*c*.

Additionally, because of a small change in the meter-in flow rate to the arm cylinder 7 at the start of opening of the center bypass opening of the arm third directional control valve 14*c*, shock at this time can be reduced.

In the hydraulic control system for a work machine according to the first embodiment of the present invention described above, the delivery flow rate of the first hydraulic pump (third hydraulic pump 20*c*) decreases with an increasing load on the first hydraulic actuator (arm cylinder 7) and the first control valve (arm third directional control valve 14*c*) is driven to enlarge a communication area between the first hydraulic pump and the tank, so that the delivery pressure of the first hydraulic pump (third hydraulic pump 20*c*) can be reduced and the pump total leakage flow rate can be reduced. A void flow rate delivered from the first hydraulic pump (third hydraulic pump 20*c*) can thus be reduced. An energy-saving hydraulic control system for a work machine can thus be provided.

Additionally, in the hydraulic control system for a work machine according to the first embodiment of the present invention described above, the delivery flow rate of the first hydraulic pump (third hydraulic pump 20*c*) is reduced before the communication area between the first hydraulic pump (third hydraulic pump 20*c*) and the tank is enlarged corresponding to the load on the first hydraulic actuator (arm cylinder 7). This reduces the bleed-off loss generated in first control valve (arm third directional control valve 14*c*). Additionally, because of a small change in the meter-in flow rate to the first hydraulic actuator (arm cylinder 7) when the first control valve (arm third directional control valve 14*c*) is opened or closed, shock at this time can be reduced.

Second Embodiment

Figure 12:
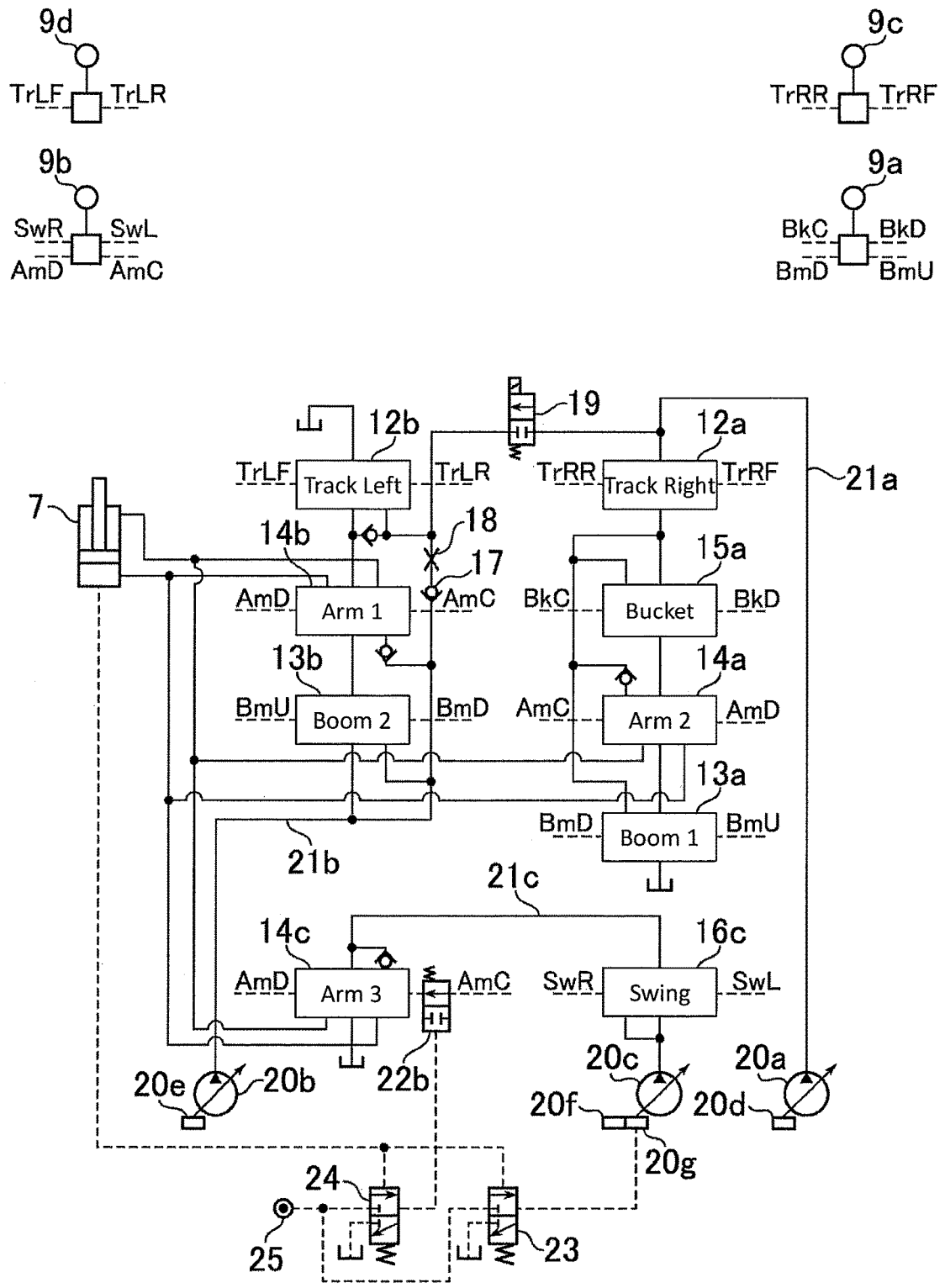
FIG. 12 is a hydraulic control circuit diagram of a hydraulic control system for a work machine according to a second embodiment.

A hydraulic control system for a work machine according to a second embodiment of the present invention is described below with reference to a relevant drawing. FIG. 12 is a hydraulic control circuit diagram of the hydraulic control system for a work machine according to the second embodiment. In FIG. 12, like or corresponding elements are identified by the same reference numerals as those used in FIGS. 1 and 11(*a*) to 11(*e*) and descriptions for those elements will be omitted.

The hydraulic control system for a work machine according to the second embodiment of the present invention has a general system configuration substantially identical to a general system configuration of the hydraulic control system for a work machine according to the first embodiment. The hydraulic control system for a work machine according to the second embodiment differs from the hydraulic control system for a work machine according to the first embodiment in that the hydraulic control system in the second embodiment is configured to incorporate only a hydraulic circuit without the controller 100.

Specifically, as shown in FIG. 12, a regulator 20*f* of a third hydraulic pump 20*c* is operated by a sub-regulator 20*g* that is driven by pilot hydraulic pressure. A pilot hydraulic fluid is supplied to the sub-regulator 20*g* via a first selecting section valve 23 from a pilot hydraulic fluid source 25. To correspond to the supply of the hydraulic fluid to the sub-regulator 20*g*, the regulator 20*f* controls the delivery flow rate of the third hydraulic pump 20*c* in a decreasing direction.

The first selecting section valve 23 is a three-port two-position selecting section valve having a spring disposed on one side and receives a hydraulic fluid of a bottom-side fluid chamber of an arm cylinder 7 introduced to an operating section thereof. The first selecting section valve 23 has an inlet port connected with a hydraulic line from the pilot hydraulic fluid source 25 and an outlet port connected with a hydraulic line to the sub-regulator 20*g*. The first selecting section valve 23 has a drain port connected with a hydraulic line to a tank.

An arm 3 crowding pressure reducing valve 22*b* is provided in an arm crowding pilot line that is connected with an operating section of an arm third directional control valve 14*c*. The arm 3 crowding pressure reducing valve 22*b* limits or interrupts the arm crowding pilot hydraulic fluid to be supplied. The arm 3 crowding pressure reducing valve 22*b* is driven by the pilot hydraulic pressure. The pilot hydraulic fluid is supplied to the arm 3 crowding pressure reducing valve 22*b* via a second selecting section valve 24 from the pilot hydraulic fluid source 25. The arm 3 crowding pressure reducing valve 22*b* enlarges a communication area between the third hydraulic pump 20*c* and the tank so as to correspond to the supply of the hydraulic fluid to the arm 3 crowding pressure reducing valve 22*b*.

The second selecting section valve 24 is a three-port two-position selecting section valve having a spring disposed on one side and receives the hydraulic fluid of the bottom-side fluid chamber of the arm cylinder 7 introduced to an operating section thereof. The second selecting section valve 24 has an inlet port connected with a hydraulic line from the pilot hydraulic fluid source 25 and an outlet port connected with a hydraulic line to an operating section of the arm 3 crowding pressure reducing valve 22*b*. The second selecting section valve 24 has a drain port connected with a hydraulic line to the tank.

It is noted that, preferably, characteristics of the first selecting section valve 23 and the second selecting section valve 24 are adjusted such that the first selecting section valve 23 performs a changeover operation before the second selecting section valve 24 does so as to correspond to an increase in pressure of the hydraulic fluid of the bottom-side fluid chamber of the arm cylinder 7 introduced to the respective operating sections.

Additionally, in the present embodiment, a maximum value of control pilot pressures that drive directional control valves disposed in respective pump lines 21*a*, 21*b*, and 21*c* may be detected and the regulators 20*d*, 20*e*, and 20*f* may be driven on the basis of the detected value.

The hydraulic control system for a work machine according to the second embodiment of the present invention described above can achieve effects similar to those achieved by the hydraulic control system for a work machine according to the first embodiment.

It should be noted that the present invention is not limited to the above-described first and second embodiments and may include various modifications. The entire detailed configuration of the embodiments described above for ease of understanding of the present invention is not always necessary to embody the present invention. Part of the configuration of one embodiment may be replaced with the configuration of another embodiment, or the configuration of one embodiment may be added to the configuration of another embodiment. The configuration of each embodiment may additionally include another configuration, or part of the configuration may be deleted or replaced with another.

DESCRIPTION OF REFERENCE NUMERALS

1: Lower track structure
2: Upper swing structure
2A: Engine
3: Boom
4: Arm
5: Bucket
6: Boom cylinder
7: Arm cylinder (first hydraulic actuator)
8: Bucket cylinder
9: Control lever (operating section)
10: Control valve
11: Swing hydraulic motor
13*a*: Boom first directional control valve
13*b*: Boom second directional control valve
14*a*: Arm second directional control valve
14*b*: Arm first directional control valve
14*c*: Arm third directional control valve (first control valve)
15*a*: Bucket directional control valve
16*c*: Swing directional control valve
20: Hydraulic pump system
20*a*: First hydraulic pump
20*b*: Second hydraulic pump (second hydraulic pump)
20*c*: Third hydraulic pump (first hydraulic pump)
20*d*: First hydraulic pump regulator
20*e*: Second hydraulic pump regulator
20*f*: Third hydraulic pump regulator
21*a*: First pump line
21*b*: Second pump line
21*c*: Third pump line
22: Arm 3 crowding pressure reducing valve (first control valve)
22*b*: Arm 3 crowding pressure reducing valve (first control valve)
23: First selecting section valve
24: Second selecting section valve
100: Controller
101 to 108: Pilot pressure sensor
110: Target operation arithmetic section
120: Communication control section (control valve drive section)
130: Flow rate control section (flow rate control section)
A7: Boom cylinder bottom-side fluid chamber pressure sensor (load detection section)

The invention claimed is:

1. A hydraulic control system for a work machine including:

a hydraulic actuator;

a first hydraulic pump and a second hydraulic pump capable of communicating with the hydraulic actuator;

a first directional control valve that is disposed in a pump line communicating with a delivery port of the first hydraulic pump and communicates with the hydraulic actuator, the first directional control valve capable of interrupting a communication between the first hydraulic pump and the hydraulic actuator and returning a hydraulic fluid delivered by the first hydraulic pump to a tank;

a second directional control valve that is disposed in a pump line communicating with a delivery port of the second hydraulic pump and communicates with the hydraulic actuator; and a first pressure sensor that detects a load on the hydraulic actuator, the hydraulic control system comprising:

a pressure reducing valve that is provided in a pilot line connected with the first directional control valve and configured to limit or interrupt a pilot hydraulic fluid to be supplied to the first directional control value;

a communication control section that takes in a detection signal detected by the first pressure sensor, outputs a command signal to the pressure reducing valve and drives the first directional control valve such that a communication area between the first hydraulic pump and the tank is enlarged corresponding to an increase in the load on the hydraulic actuator; and a flow rate control section that, during supply of the hydraulic fluid from the first hydraulic pump and the second hydraulic pump to the hydraulic actuator, takes in a detection signal detected by the first pressure sensor and controls to reduce a delivery flow rate of the first hydraulic pump corresponding to an increase in the load on the hydraulic actuator.

2. The hydraulic control system for a work machine according to claim 1, wherein the flow rate control section controls to reduce the delivery flow rate of the first hydraulic pump before the communication control section drives the first directional control valve such that the communication area between the first hydraulic pump and the tank is enlarged corresponding to an increase in the load on the hydraulic actuator.

3. The hydraulic control system for a work machine according to claim 1, wherein the flow rate control section is further capable of controlling to reduce a delivery flow rate of the second hydraulic pump, and the flow rate control section controls to reduce the delivery flow rate of the first hydraulic pump before controlling to reduce the delivery flow rate of the second hydraulic pump corresponding to an increase in the load on the hydraulic actuator.

4. The hydraulic control system for a work machine according to claim 1, further comprising:

a operating section that instructs an operation of the hydraulic actuator; and a second pressure sensor that detects an operation amount of the operating section, wherein the flow rate control section takes in a detection signal detected by the second pressure sensor and, corresponding to an increase in the operation amount of the operating section, increases the flow rate of the hydraulic fluid to be supplied from the second hydraulic pump to the hydraulic actuator before increasing the flow rate of the hydraulic fluid to be supplied from the hydraulic pump to the hydraulic actuator.

5. The hydraulic control system for a work machine according to claim 1, wherein the delivery flow rate of the first hydraulic pump reduced by the flow rate control section is a standby flow rate of the first hydraulic pump.

* * * * *